United States Patent [19]

Kato et al.

[11] Patent Number: 4,627,571

[45] Date of Patent: Dec. 9, 1986

[54] FUEL INJECTION NOZZLE

[75] Inventors: Masaaki Kato; Hirotaka Nakatsuka, both of Kariya; Shigeki Tojo, Mie; Kazuyoshi Arai, Toyota, all of Japan

[73] Assignee: Nippondenso Co., Ltd., Kariya, Japan

[21] Appl. No.: 711,838

[22] Filed: Mar. 14, 1985

[30] Foreign Application Priority Data

Mar. 15, 1984 [JP] Japan ..... 59-49664

[51] Int. Cl.[4] ..... F02M 47/02

[52] U.S. Cl. ..... 239/90; 239/96; 239/124; 239/533.12; 239/574; 123/467; 123/496; 123/506

[58] Field of Search ..... 239/88, 89, 90, 91–96, 239/124, 126, 533.2–533.12, 571, 574; 123/447, 467, 496, 506

[56] References Cited

U.S. PATENT DOCUMENTS

| | | | |
|---|---|---|---|
| 2,283,725 | 5/1942 | Eichelberg | 239/533.8 X |
| 2,788,246 | 4/1957 | Nichols | 239/96 |
| 4,129,256 | 12/1978 | Bader, Jr. et al. | 239/96 |
| 4,349,152 | 9/1982 | Akagi | 239/96 |
| 4,367,846 | 1/1983 | Akagi | 239/96 |
| 4,436,247 | 3/1984 | Akagi | 239/533.7 |
| 4,513,719 | 4/1985 | Edo | 239/96 X |
| 4,561,590 | 12/1985 | Akagi | 239/96 |

FOREIGN PATENT DOCUMENTS

| | | | |
|---|---|---|---|
| 59-85433 | 5/1984 | Japan . | |
| 634024 | 3/1950 | United Kingdom | 239/533.5 |

*Primary Examiner*—Joseph F. Peters, Jr.
*Assistant Examiner*—Mary Beth O. Jones
*Attorney, Agent, or Firm*—Cushman, Darby & Cushman

[57] ABSTRACT

A fuel injection nozzle of the present invention has an accumulating chamber in a body in which high pressure fuel fed from the fuel injection pump is stored using a non-return valve. A needle valve is arranged in the body to inject the fuel in the accumulating chamber. A nozzle needle of the needle valve and a valve member are arranged coaxially and in series with each other. Those end portions of the nozzle needle and valve member which are adjacent to each other are slidably and liquid-sealingly fitted together to define a damping chamber between the valve member and the nozzle needle. Further, a damping plunger is coaxially fitted into the valve member. A passage which connects the damping chamber with the side of the fuel injection pump is coaxially formed in the damping plunger and has a reduced area.

8 Claims, 3 Drawing Figures

FUEL INJECTION NOZZLE

BACKGROUND OF THE INVENTION

The present invention relates to a fuel injection nozzle for injecting highly-pressurized fuel into the combustion chamber in the internal combustion engine such as a diesel engine.

The fuel injection nozzle of this type was disclosed in U.S. Pat. No. 4,349,152 and Japanese Patent Disclosure No. 85,433/85. These well-known fuel injection nozzles are provided with accumulating chambers defined in their bodies, into which highly-pressurized fuel fed from the fuel injection pumps is introduced. When the highly-pressurized fuel is introduced into the accumulating chamber, pressure in the valve chamber of the body which is communicated with the accumulating chamber is also raised. Therefore, the nozzle needle is lifted by this pressure in the valve chamber and fuel in the accumulating and valve chambers is thus injected through the injection hole.

In the case of these above-described fuel injection nozzles of the pressure accumulation type, however, the fuel injection is attained using the accumulated energy of fuel filled in the accumulating chamber. Therefore, pressure in the accumulating chamber is maximum at the start of the fuel injection, then lowers gradually, and is minimum at the end of the fuel injection. In other words, the nozzle needle opens the injection hole to the maximum degree at the start of the fuel injection and then gradually makes it smaller. As a result, fuel injection ratio is maximum at the start of the fuel injection, and then gradually decreases toward the end of the fuel injection. Combustion pressure in the combustion chamber rises rapidly to thereby increase combustion sound and engine noise. In addition, temperature in the combustion chamber rises rapidly to thereby increase the amount of $NO_x$ generated.

SUMMARY OF THE INVENTION

The present invention is therefore intended to eliminate the above-described drawbacks and the object of the present invention is to provide a fuel injection nozzle capable of increasing the fuel injection ratio at the end of the fuel injection than at the start thereof to reduce engine noise and restrain $NO_x$ from being generated.

The object of the present invention can be achieved by a fuel injection nozzle according to the present invention. The fuel injection nozzle of the present invention is provided with a body, in which an accumulating chamber which can be communicated with the discharge side of a fuel injection pump is defined. The fuel injection nozzle comprises a non-return valve means for shutting off the communication between the discharge side of the fuel injection pump and the accumulating chamber to store fuel, which is supplied from the fuel injection pump and which has certain pressure and quantity, in the accumulating chamber. The non-return valve includes a valve member movable along the axis of the body. The valve member has a connector hole at one end thereof which is usually connected with the discharge side of the fuel injection pump. The fuel injection nozzle further comprises a needle valve means for injecting fuel in the accumulating chamber into the combustion chamber of the engine. The needle valve means includes a nozzle needle arranged coaxially and in series with the valve member. Either the other end of the valve member or one end of the nozzle needle is slidable and liquid-tightly fitted into the other for defining a damping chamber between the two end portions of the nozzle needle and valve member. A damping plunger is coaxially fitted into the valve member in the manner that it can abut the nozzle needle and it is urged toward the nozzle needle. A through-hole which communicates the damping chamber with the connector hole is formed in the damping plunger and has a reduced area.

According to the above-described fuel injection nozzle, the damping chamber is defined between the valve member and the nozzle needle. Therefore, as the nozzle needle is lifted by pressure in the accumulating chamber at the start of fuel injection, pressure in the damping chamber is raised accordingly because the volume of the damping chamber is reduced. This pressure rise in the damping chamber acts to restrain the lift of the nozzle needle. As a result, the opening degree of the needle valve remains small at the start of the fuel injection even if the pressure in the accumulating chamber is high, thereby enabling the fuel injection ratio to be reduced. As the fuel injection comes nearer to its end, fuel in the damping chamber escapes into the connector hole through the through-hole and reduced area to thereby reduce the pressure gradually in the damping chamber. As the pressure in the damping chamber is reduced, however, the nozzle needle is lifted accordingly to further reduce the volume of the damping chamber, so that a sudden fall of pressure in the damping chamber can be prevented. The nozzle needle is quickly lifted after a predetermined delay time from the start of fuel injection to increase the opening degree of the needle valve, thereby enabling the fuel injection ratio to increase at the end of fuel injection rather than at the start thereof. Therefore, the amount of $NO_x$ generated as well as engine noise can be reduced due to the characteristic of the fuel injection ratio.

DETAILED DESCRIPTION OF THE PREFERRED EMBODIMENTS

Figure 1:
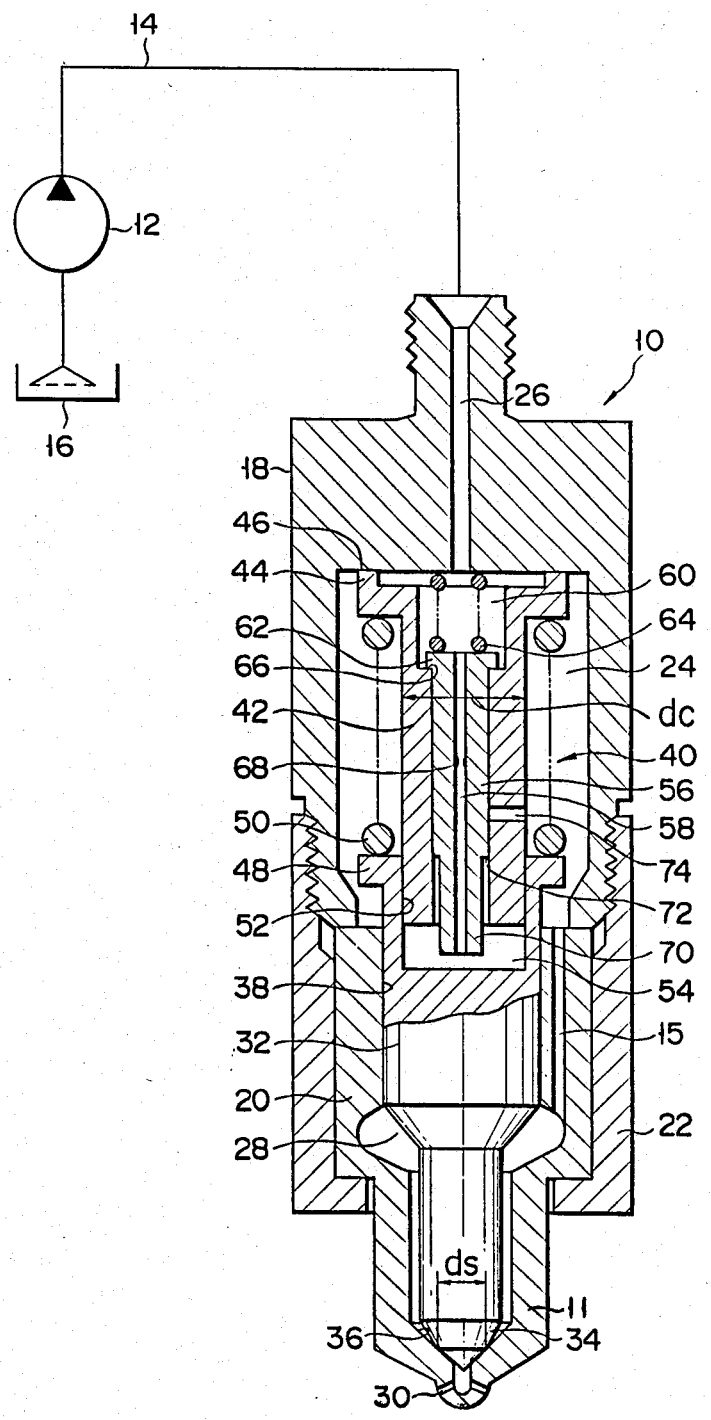
FIG. 1 is a sectional view showing a first example of the fuel injection nozzle of the present invention.

FIG. 1 shows a first example of the fuel injection nozzle according to the present invention. The fuel injection valve 10 is connected to a fuel injection pump 12 through a fuel pipe 14. The fuel injection pump 12 is of a well-known in-line or distributor type. The fuel injection pump 12 is driven by an engine (not shown) to feed a predetermined amount of fuel from a fuel tank 16 to the fuel injection nozzle 10 for a predetermined time period in response to the number of engine rotation.

The fuel injection nozzle 10 is provided with a holder and nozzle bodies 18 and 20 which are coaxially connected with each other through a retaining nut 22. An accumulating chamber 24 is defined in the holder body 18. The accumulating chamber 24 can be connected to the fuel pipe 14 through a suction passage 26 which is coaxially formed in the holder body 18. On the other hand, the accumulating chamber 24 is also communicated with a valve chamber 28 in the nozzle body 20 through a passage 15 which is formed in the nozzle body 20.

Plural injection holes 30 are arranged at the foremost end of the nozzle body 20 and can be communicated with the valve chamber 28. The injection holes 30 are open and closed by contacting and separating a needle seat 34 of a nozzle needle 32 relative to a body seat 36 of the nozzle body 20. The nozzle needle 32 is slidably fitted into a guide hole 38 which is coaxially formed in the nozzle body 20, and the upper end of the nozzle needle 32 is projected into the accumulating chamber 24.

A check valve 40 is housed in the accumulating chamber 24. The check valve 40 has a column-like valve member 42 extending coaxial to the holder body 18. The upper portion of the valve member 42 is formed as a large-diameter portion 44, whose upper end surface is defined as a valve seat 46. A pressure spring 50 is arranged between the large-diameter portion 44 of the valve member 42 and a flange portion 48 on the upper end of the nozzle needle 32. The valve member 42 is urged against the ceiling of the accumulating chamber 24 by means of the pressure spring 50. The communication between the suction passage 26 and the accumulating chamber 24 is shut off under this state. On the other hand, the nozzle needle 32 is also urged against the body seat 36 at the needle seat 34 thereof by means of the pressure spring 50, thereby keeping the injection holes 30 closed.

The lower end portion of the valve member 42 is slidably inserted into a blind hole 52 which is coaxially formed in the upper portion of the nozzle needle 32. A damping chamber 54 is thus defined in the blind hole 52 by means of the lower end surface of the valve member 42. A damping plunger 56 is coaxially fitted into the valve member 42 to move along the axis of the valve member 42. A through-hole 58 having a small diameter is coaxially formed in the damping plunger 56, passing through the damping plunger 56. This through-hole 58 communicates the damping chamber 54 with a connector hole 60 which is formed in the upper end portion of the valve member 42 and which has a diameter larger than that of the damping plunger 56. The damping plunger 56 is urged by a spring 64 housed in the connector hole 60. The damping plunger 56 is thus held contacted with a lower end face 66 of the connector hole 60 at the flange portion 62 thereof. A reduced area 68 is formed in the middle of the through-hole 58 in the damping plunger 56. The lower end portion of the damping plunger 56 is formed as a small-diameter portion 70 and the upper end of this small-diameter portion 70 is formed as a spill lead 72. A spill hole 74 which is communicated with the accumulating chamber 24 is formed in the valve member 42 in the radial direction thereof. This spill hole 74 co-operates with the spill lead 72 to establish and shut off the communication between the accumulating chamber 24 and the damping chamber 54.

The above-described first example of the fuel injection nozzle 10 will be described on its operation, referring to a timing chart shown in FIG. 2.

When high pressure fuel is fed from the fuel injection pump 12 to the fuel injection nozzle 10, it is introduced into the connector hole 60 through the suction passage 26. The flange portion 62 of the damping plunger 56 is urged against the lower end face 66 of the connector hole 60 by the high pressure fuel introduced into the connector hole 60. On the other hand, the high pressure fuel in the connector hole 60 flows into the damping chamber 54 through the throughhole 58. When the damping chamber 54 is filled with the high pressure fuel, pressure Pc in the connector hole 60 rises and the valve member 42 of the check valve 40 is lifted at a point A in FIG. 2 against the pressure spring 50, thereby causing the check valve 40 to be opened. Since the suction passage 26 is thus communicated with the accumulating chamber 24, the high pressure fuel fed from the fuel injection pump 12 flows into the accumulating chamber 24 as well as the connector hole 60. Pressure Pacc in the accumulating chamber 24 is thus raised.

Figure 2:
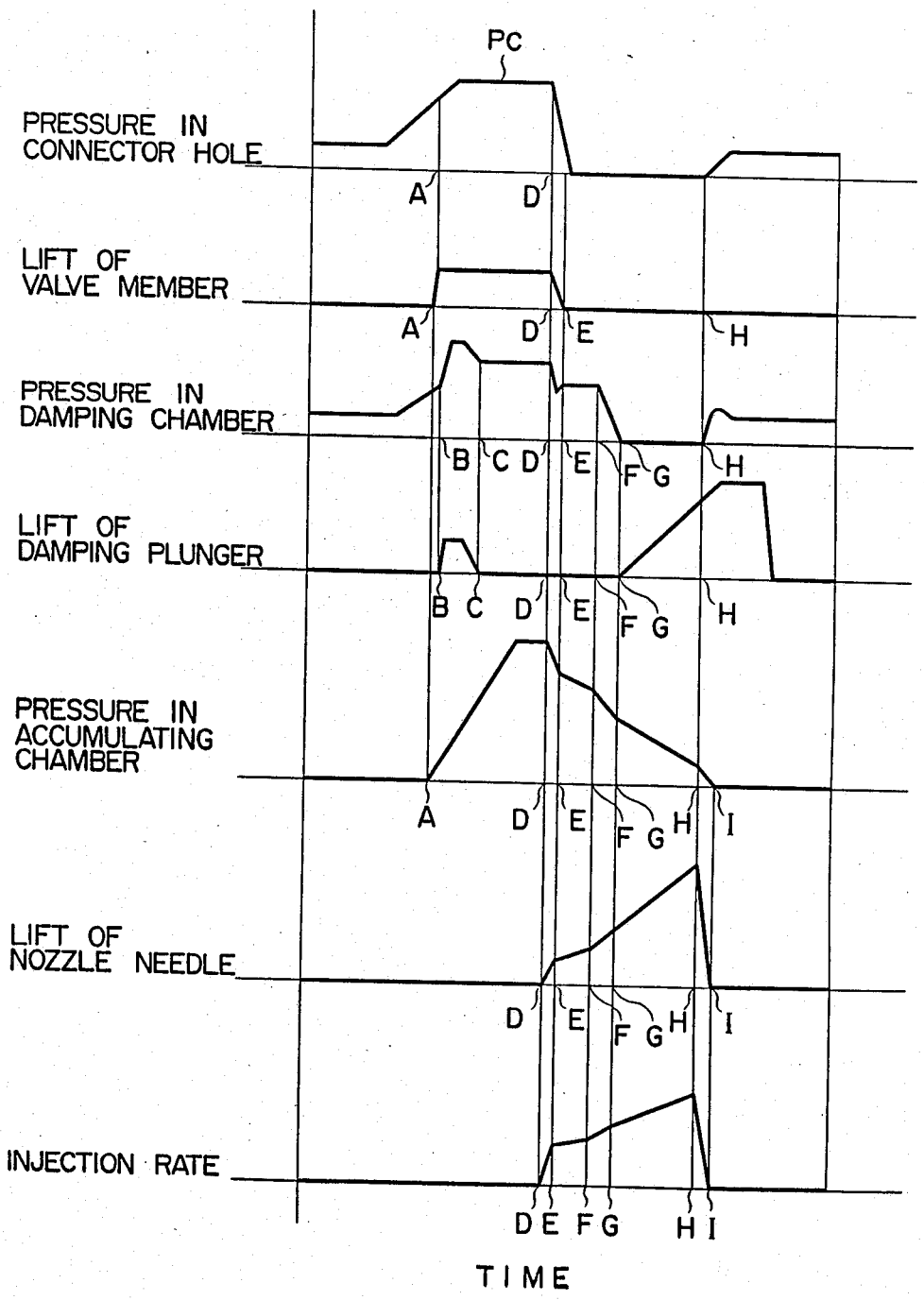
FIG. 2 is a timing chart intended to explain the operation of the fuel injection nozzle shown in FIG. 1.

When the valve member 42 is lifted, the volume of the damping chamber 54 is reduced and pressure Pd in the damping chamber 54 is thus raised rapidly at a point B in FIG. 2. The damping plunger 56 is therefore lifted by the pressure Pd in the damping chamber 54 against the spring 64. Since the pressure Pd in the damping chamber 54 gradually escapes into the connector hole 60 through the through-hole 58 and reduced-area 68 in the damping plunger 56, it then reduces at a point C in FIG. 2. The damping plunger 56 is thus lowered by the spring 64.

When the supply of high pressure fuel into the accumulating chamber 24 continues from the point A at which the check valve 40 is open, the pressure Pacc in the accumulating chamber 24 rises higher. When fuel delivery from the fuel injection pump 12 is completed, pressure in the fuel pipe 14 is relieved on the side of the fuel injection pump 12. Therefore, pressures Pc and Pacc in the connector hole 60 and accumulating chamber 24 reduces at a point D in FIG. 2 and the valve member 42 of the check valve 40 is thus forced to abut the ceiling of the accumulating chamber 24 at the point D by means of the pressure spring 50. Therefore, the check valve 40 is closed at a point E in FIG. 2 to shut off the communication between the suction passage 26 and the accumulating chamber 24. After the check valve 40 is closed, the pressure Pacc in the accumulating chamber 24 is prevented from escaping on the side of the pump 12. However, the pressure Pc in the connector hole 60 is allowed to escape on the side of the pump 12 even after the point E.

Since the volume of the damping chamber 54 is increased by the valve member 42 lifted, the pressure Pd in the damping chamber 54 is quickly lowered from a point F in FIG. 2.

It will be taken into consideration how the nozzle needle 32 which is under the pressure of fuel in the valve chamber 28 is moved, the valve chamber 28 being communicated with the accumulating chamber 24 and following any pressure change in the accumulating chamber 24. When the valve member 42 starts rising from the point D, the pressure spring 50 is extended to thereby reduce its urging force, and when the pressure Pd in the damping chamber 54 is rapidly decreased, as described above, from the point D, the force which pushes down the nozzle needle 32 is also rapidly reduced. Therefore, the nozzle needle 32 begins to lift from the point D. As a result, the needle seat 34 of the nozzle needle 32 is separated from the body seat 36 to open the injection holes 30. Therefore, fuel injection through these fuel injection holes 30 is started at the point D.

When the nozzle needle 32 is thereafter lifted to reduce the volume of the damping chamber 54, the pressure Pd in the damping chamber 54 is again raised until the point E. The rise of the nozzle needle 32 is thus restrained during the time period starting from the point E and ending in the point F in FIG. 2.

The pressure Pd in the damping chamber 54 begins to decrease from the point F in FIG. 2 because fuel in the damping chamber 54 escapes on the side of the pump 12 through the through-hole 58, reduced-area 68 and connector hole 60. Therefore, the force which restricts the lifting of the nozzle needle 32 is reduced, the nozzle needle 32 is lifted faster, widening the gap between the needle and body seat 34 and 36 to increase the amount of fuel injected through the injection holes 30.

When the bottom of the damping chamber 54 in the nozzle needle 32 is abutted on the lower end of the damping plunger 56 at a point G in FIG. 2, the spring 64 further acts as a force which restrains the lifting of the nozzle needle 32. However, fuel pressure in the accumulating chamber 24 or valve chamber 28 also acts on the nozzle needle 32. The nozzle needle 32 is therefore lifted together with the damping plunger 56 against the spring 64. The gap between the needle seat 34 of the nozzle needle 32 and the body seat 36 is made larger to further increase the amount of fuel injected through the injection holes 30.

When the nozzle needle 32 continues to lift together with the damping plunger 56, the spill lead 72 of the damping plunger 56 opens the spill port 74 at a point H in FIG. 2, the fuel in the accumulating chamber 24 flows into the damper chamber 54. Therefore, fuel pressure in the accumulating chamber 24 is decreased, while the pressure Pd in the damping chamber 54 is raised. Therefore, the pressure in the valve chamber 28 which is communicated with the accumulating chamber 24 is balanced to the pressure in the damping chamber 54 and the nozzle needle 32 is quickly lowered by the pressure spring 50. Thus, the needle seat 34 of the nozzle needle 32 contacts the body seat 36 to close the injection holes 30 at a point I in FIG. 2, thereby completing the fuel injection.

According to the above-described example the characteristic of injection ratio follows the lifting movement of the nozzle needle 32, as shown in FIG. 2. In other words, the injection ratio is small at the start of injection but then gradually becomes greater.

Static balance in the nozzle needle 32 at the time when the nozzle needle 32 is lifted is represented as follows:

$$F_{SD} = \frac{\pi}{4}\,[(d_c^2 - d_S^2) \times Pacc - d_c^2 \times Pd]$$

wherein $F_{SD}$ represents a set load of the pressure spring 50, $d_c$ an effective outer diameter of the valve member 42, $d_S$ a seat diameter of the nozzle needle 32, Pacc a pressure in the accumulating chamber 24 and Pd a pressure in the damping chamber 54.

Therefore, the force which acts to lift the nozzle needle 32 or nozzle opening pressure Po in the accumulating chamber 24 is as follows:

$$Po = Pacc = \left(F_{SD} \times \frac{4}{\pi} + d_c^2 \times Pd\right) / (d_c^2 - d_S^2)$$

On the contrary, the force which acts on the nozzle needle 32 in the axial direction at the time when the nozzle 10 is closed becomes as follows:

$$\frac{\pi}{4}\,(d_c^2 \times Pacc - d_c^2 \times Pd) = 0$$

because Pacc=Pd. Therefore, the urging force $F_{SD}$ of the pressure spring 50 (or $F_{SD}$=spring constant-×amount of the nozzle needle lifted) is only left to act as a force to the nozzle needle 32. The nozzle needle 32 is thus strongly pushed down so that the nozzle 10 can be instantaneously closed, thereby improving the cutoff of the fuel injection.

Figure 3:
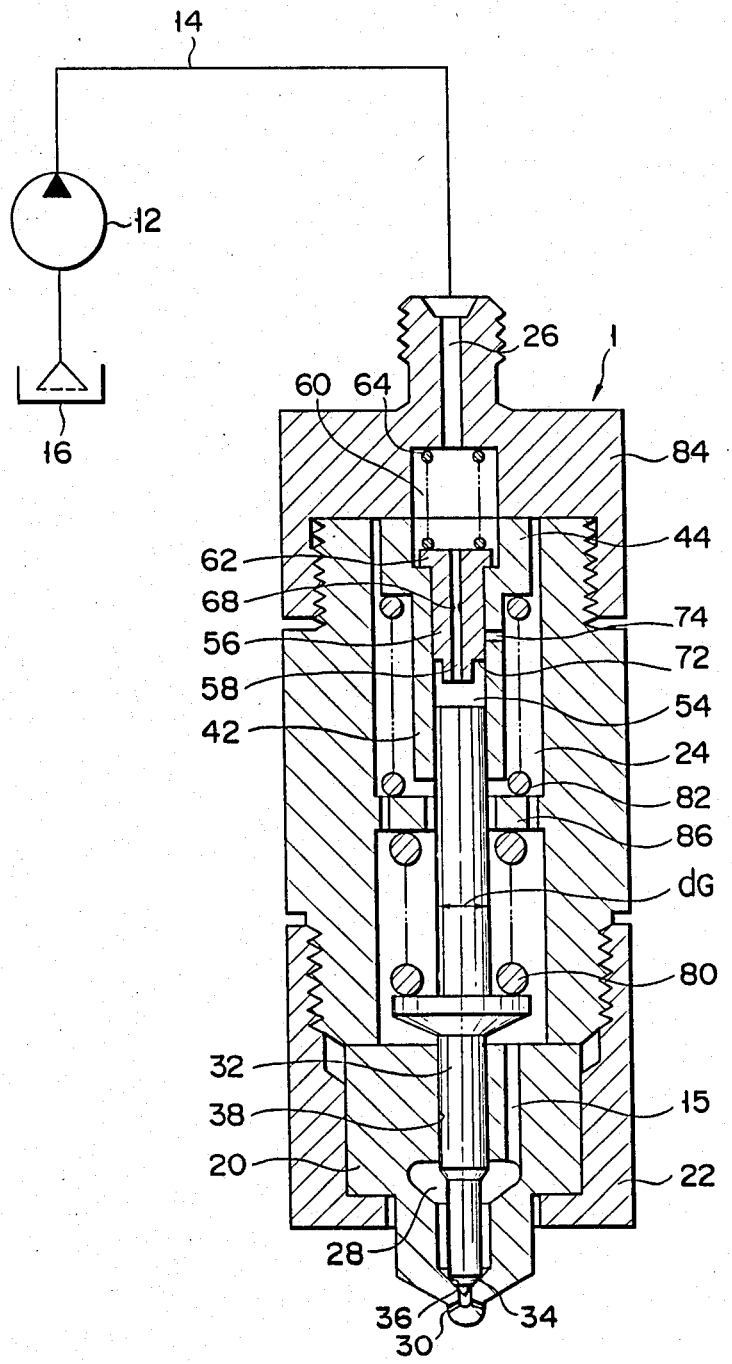
FIG. 3 is a sectional view showing a second example of the fuel injection nozzle according to the present invention.

FIG. 3 shows a second example of the fuel injection nozzle according to the present invention. The second example is different from the first one shown in FIG. 1 in that a pressure spring 80 for the nozzle needle 32 is arranged independently of a spring 82 for the valve member 42, and that the nozzle needle 32 is guided by a guide hole 38 in the nozzle body 20 and by the hollow portion of the valve member 42. In FIG. 3, numeral 86 represents a stopper wall for the springs 80 and 82, and numeral 84 represents a cap. Other parts in FIG. 3 are represented by the same reference numerals as those in FIG. 1, and a description on these parts will be omitted.

According to the second example, the nozzle needle 32 and valve member 42 are urged by their respective springs 80 and 82. Therefore, their set loads can be independently determined. More specifically, the nozzle opening pressure can be determined by the load which is set on the pressure spring 80, and the amount of the nozzle needle 32 lifted is set by the amount of the moved damping plunger 56. The valve member opening pressure of the check valve can be determined by the load which is set on the spring 82, and the amount of the valve member 42 lifted is set by the position of the valve member 42 which abuts the stopper wall 86.

Static balance in the nozzle needle 32 at the time of opening the nozzle 10 is represented as follows:

$$F_{SD} = \frac{\pi}{4}\,[(d_G^2 - d_S^2) \times Pacc - d_G^2 \times Pd]$$

wherein $d_G$ represents an outer diameter of a guide rod portion for the nozzle needle 32.

Therefore, the nozzle opening pressure Po is as follows:

$$Po = Pacc = \left(F_{SD} \times \frac{4}{\pi} + d_G^2 \times Pd\right) / (d_G^2 - d_S^2)$$

The example shown in FIG. 3 can achieve the same operation as that of the one shown in FIG. 2, but the former is different from the latter in that the nozzle opening can be attained simultaneously at the check valve opening. More specifically, when the valve member 42 starts to move toward the closing direction and the pressure in the damping chamber 54 begins to reduce, the nozzle needle 32 is lifted against the pressure spring 80 to thereby open the injection holes 30 at the same time. Since the pressure in the damping chamber 54 rises following the lifting of the nozzle needle 32, the nozzle needle 32 is slowly lifted so that the injection ratio is small at the start of the fuel injection. Thereafter, the operation of the second example until the fuel injection is completed is the same as that of the first one shown in FIG. 1.

What is claimed is:

1. A fuel injection nozzle which is adapted to be connected to a fuel injection pump and which serves to inject fuel into a combustion chamber in an internal combustion engine, comprising:

a body in which a suction passage and an accumulating chamber are defined, the suction passage being adapted to be connected with a fuel injection pump and the accumulating chamber being connected with the suction passage;

a non-return valve means for allowing the fuel to flow from the suction passage to the accumulating chamber but prohibiting the fuel from flowing from the accumulating chamber to the suction passage, thereby storing the fuel in the accumulating chamber, the fuel being supplied from a fuel injection pump and having a certain pressure and amount, and the non-return valve means including a valve nember which is arranged in the accumulating chamber, is movable along the axis of the body and is urged, with a predetermined force, in a direction for closing the connection between the suction passage and the accumulating chamber, a connector recess being formed at one end of the valve member that faces the suction passage, the connector recess communicating with the suction passage even when the connection is closed;

a needle valve means for injecting the fuel stored in the accumulating chamber into a combustion chamber in an engine, the needle valve means including a nozzle needle arranged coaxially and in series with the valve member with end portions thereof being adjacent, the nozzle needle being urged in the opposite direction to the valve member, one of the adjacent end portions of the valve member and the nozzle needle being slidably and liquid-tightly fitted into the other to define therein a damping chamber;

a damping plunger coaxially fitted into the valve member in the manner that the damping plunger is urged toward the nozzle needle and has one end protruding into the damping chamber and engageable by the nozzle needle, the damping plunger including a through hole for communicating the damping chamber with the connector recess; and throttle means disposed in the through hole in the damping plunger, for restricting the fuel flow between the damping chamber and the connector recess.

2. A fuel injection nozzle according to claim 1, wherein the damping chamber is defined by slidably and liquid-tightly fitting the end portion of the valve member into a recess formed at the adjacent end portion of the nozzle needle.

3. A fuel injection nozzle according to claim 2, wherein the non-return valve means and needle valve neans further include a common compression coil spring for urging both the valve member and nozzle needle, and the compression coil spring is arranged between the valve member and the nozzle needle, and surrounds the valve member.

4. A fuel injection nozzle according to claim 1, wherein said non-return valve means further includes means for communicating the damping chamber with the accumulating chamber at a predetermined timing, when the damping plunger is engaged by and moved a predetermined distance with the nozzle needle.

5. A fuel injection nozzle according to claim 4, wherein the communication means includes a spill hole radially formed in the valve member, opening into the accumulating chamber at one end thereof and noramlly closed by the outer surface of the damping plunger at the other end thereof, and a samll-dimaeter spill lead, formed at one end of the damping plunger, for opening the connection between the spill hole and the damping chamber when the damping plunger is moved a predetermined distance by and with the nozzle needle.

6. A fuel injection nozzle according to claim 1, wherein the non-return valve means and needle valve means include respective compression coil springs for urging the valve member and nozzle needle independently of each other.

7. A fuel injection nozzle according to claim 6, wherein the damping chamber is defined by slidably and liquid-tightly fitting one end portion of the nozzle needle into the other end portion of the valve member.

8. A fuel injection nozzle according to claim 1, wherein said throttle means includes an orifice.

* * * * *